US008353259B2

(12) United States Patent
Strock et al.

(10) Patent No.: US 8,353,259 B2
(45) Date of Patent: Jan. 15, 2013

(54) MASKING FIXTURE FOR A COATING PROCESS

(75) Inventors: Christopher W. Strock, Kennebunk, ME (US); Thomas E. Lang, Lebanon, ME (US)

(73) Assignee: United Technologies Corporation, Hartford, CT (US)

( * ) Notice: Subject to any disclaimer, the term of this patent is extended or adjusted under 35 U.S.C. 154(b) by 1172 days.

(21) Appl. No.: 11/844,382

(22) Filed: Aug. 24, 2007

(65) Prior Publication Data

US 2009/0053422 A1 Feb. 26, 2009

(51) Int. Cl.
*B05C 11/11* (2006.01)
*B25B 27/14* (2006.01)

(52) U.S. Cl. ..... 118/505; 29/281.1

(58) Field of Classification Search ..... 211/41.18, 211/1.52, 1.53, 1.55; 451/384; 118/505, 118/318; 248/131, 132, 415, 205.1, 186.2; 29/281.1
See application file for complete search history.

(56) References Cited

U.S. PATENT DOCUMENTS

| | | | | | |
|---|---|---|---|---|---|
| 3,122,867 | A | * | 3/1964 | Gross | 451/381 |
| 3,806,360 | A | * | 4/1974 | Briody | 117/98 |
| 4,154,436 | A | * | 5/1979 | Sellers | 269/14 |
| 4,485,759 | A | | 12/1984 | Brandolf | |
| 4,608,128 | A | | 8/1986 | Farmer | |
| 4,610,698 | A | | 9/1986 | Eaton | |
| 4,680,199 | A | | 7/1987 | Vontell | |
| 4,682,562 | A | * | 7/1987 | Hell | 118/500 |
| 4,694,779 | A | * | 9/1987 | Hammond et al. | 118/730 |
| 4,699,085 | A | * | 10/1987 | Purdes | 118/725 |
| 4,823,736 | A | * | 4/1989 | Post et al. | 118/730 |
| 4,962,722 | A | * | 10/1990 | Thompson | 118/504 |
| 5,486,281 | A | | 1/1996 | Gruver | |
| 5,565,035 | A | * | 10/1996 | Sylvestro et al. | 118/721 |
| 5,607,561 | A | | 3/1997 | Gruver | |
| 5,702,574 | A | * | 12/1997 | Foster et al. | 204/224 R |
| 5,792,267 | A | | 8/1998 | Marszal | |
| 5,998,755 | A | | 12/1999 | Zajchowski | |
| 6,037,004 | A | | 3/2000 | Zajchowski | |
| 6,122,114 | A | * | 9/2000 | Sudo et al. | 359/819 |
| 6,258,227 | B1 | * | 7/2001 | Flanigan | 204/298.11 |
| 6,318,571 | B1 | * | 11/2001 | Maumus et al. | 211/194 |
| 6,419,753 | B1 | * | 7/2002 | Wheat et al. | 118/721 |
| 6,520,191 | B1 | * | 2/2003 | Iwamoto et al. | 134/184 |
| 6,579,567 | B1 | | 6/2003 | Das | |
| 6,964,599 | B2 | * | 11/2005 | Incera et al. | 451/24 |
| 2002/0000200 | A1 | * | 1/2002 | Mizuno | 118/722 |
| 2008/0050522 | A1 | * | 2/2008 | Yang et al. | 427/249.1 |

FOREIGN PATENT DOCUMENTS

| | | |
|---|---|---|
| EP | 1630256 | 1/2006 |
| FR | 2818620 | 6/2002 |
| JP | 2005021857 | 1/2005 |

OTHER PUBLICATIONS

European Search Report dated Nov. 24, 2008.

* cited by examiner

*Primary Examiner* — Dah-Wei Yuan
*Assistant Examiner* — Charles Capozzi
(74) *Attorney, Agent, or Firm* — Carlson, Gaskey & Olds

(57) ABSTRACT

A masking fixture for use in a coating process includes a first fixture plate for supporting a first work piece, a second fixture plate spaced from the first fixture plate for supporting a second work piece, and at least one spacer secured between the first fixture plate and the second fixture plate.

21 Claims, 3 Drawing Sheets

MASKING FIXTURE FOR A COATING PROCESS

BACKGROUND OF THE INVENTION

This disclosure relates to fixtures for use in coating processes and, more particularly, to fixtures that can be stacked with work pieces that are to be coated in order to mask a portion of the work pieces.

Coating processes are known and used to deposit organic, metallic, ceramic, or other types of coatings on a component work piece. Depending on the design of the component, certain portions of the component may be coated while other portions are to remain uncoated. For example, portions of the component may be masked with a tape in attempt to prevent deposition of the coating on the masked portion. However, using tape may involve considerable time and/or labor to apply and remove the tape. Furthermore, if a spray coating process is used, the coating material may deflect off of the tape and interfere with the coating process.

A support may be used to mount one or more components in a desired orientation for the coating process. Typically, the support is exposed to the coating during the coating process, becomes coated and/or deflects the coating material. If the coating adheres to the support, the support may require considerable time and labor for cleaning to limit coating build-up. Furthermore, if the coating deflects off of the support, the deflected coating may interfere with the coating process and/or be deposited on areas where no coating is desired.

SUMMARY OF THE INVENTION

An example masking fixture for use in a coating process includes a first fixture plate for supporting a first work piece, a second fixture plate spaced from the first fixture plate for supporting a second work piece, and at least one spacer secured between the first fixture plate and the second fixture plate. In one example, the at least one spacer includes a knife edge for limiting deflection and adherence of a coating.

In one example, a plurality of the masking fixtures are stacked with a plurality of work pieces that are to be coated. For example, each of the work pieces is supported between two of the masking fixtures.

An example method of arranging the masking fixtures and the work pieces for a coating process includes the steps of stacking a plurality of the masking fixtures with the plurality of work pieces, and masking a portion of one of the work pieces using a first one of the masking fixtures and a second one of the masking fixtures.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

The example masking fixtures described herein facilitate reduction of masking tape usage and coating build-up and deflection on a work piece that is to be subjected to a coating process.

Figure 1:
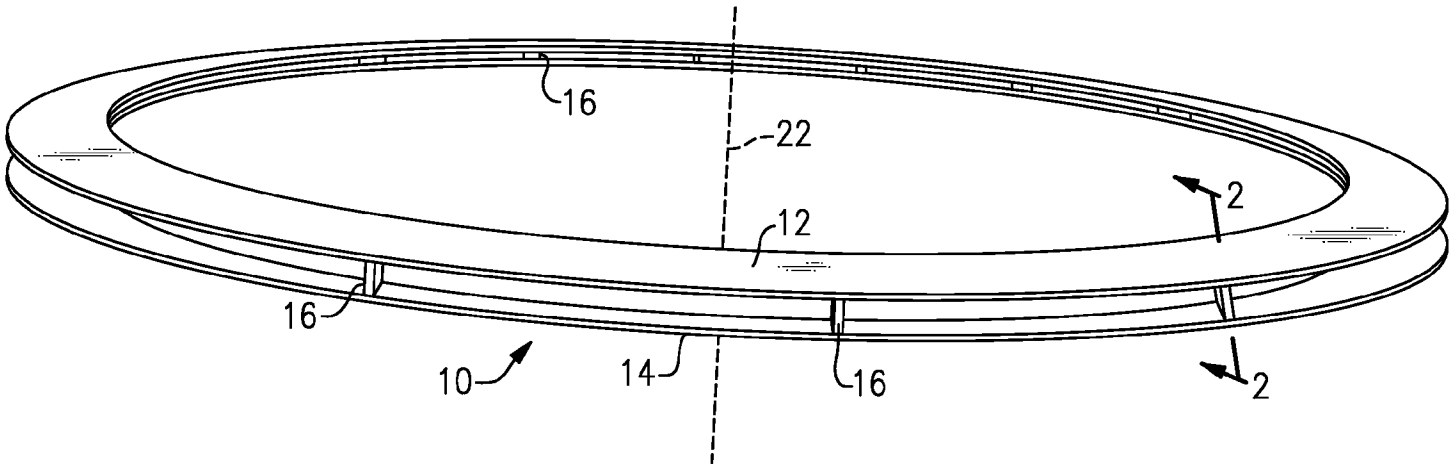
FIG. 1 illustrates a perspective view of an example masking fixture.

FIG. 1 illustrates a perspective view of an example masking fixture 10 for use in a coating process to support work pieces that are to be coated. For example, the masking fixture 10 in the illustrated example may support a circular work piece, such as a compressor outer air seal ring for a gas turbine engine. However, given this description, one of ordinary skill in the art will recognize that in other examples the masking fixture 10 may have a different shape that is suitable for supporting other shapes of work pieces. Compared to at least some known fixtures, the masking fixture 10 provides a durable and dimensionally stable support for positioning work pieces, reduces the amount of masking tape, and reduces deflection of coating material.

Figure 2:
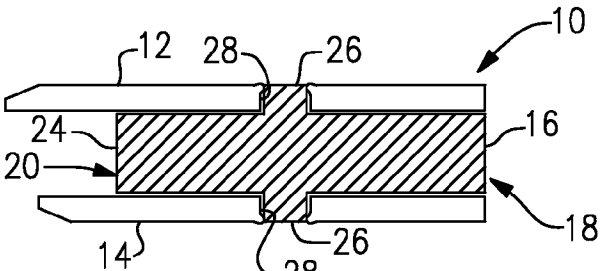
FIG. 2 illustrates a cross-sectional view of the example masking fixture.

Referring also to FIG. 2, the example masking fixture 10 includes a first fixture plate 12 and a second fixture plate 14 that is spaced apart from the first fixture plate 12. In the disclosed example, each of the first fixture plate 12 and the second fixture plate 14 is a substantially flat plate in the form of a ring that is approximately concentric with a center axis 22 of the masking fixture 10. In this regard, the fixture plates 12 and 14 include arced portions, but may not necessarily be complete rings. The term "substantially" and "approximately" as used in this disclosure refer to a nominal geometry within a desired tolerance. It is to be understood that the plates 12 and 14 may not be complete rings and that other shapes may be used, depending on the shape of the work pieces. In one example, the first fixture plate 12 and the second fixture plate 14 are each formed from stainless steel in a known manner, such as by machine cutting.

The masking fixture 10 includes a plurality of spacers 16 located between the first fixture plate 12 and the second fixture plate 14. In the disclosed example, the plurality of spacers 16 is uniformly spaced around a circumference of the masking fixture 10. In other examples, and depending upon the shape of the first fixture plate 12 and the second fixture plate 14, additional spacers 16 or fewer spacers 16 than shown in the illustrated example may be used.

Figure 4:
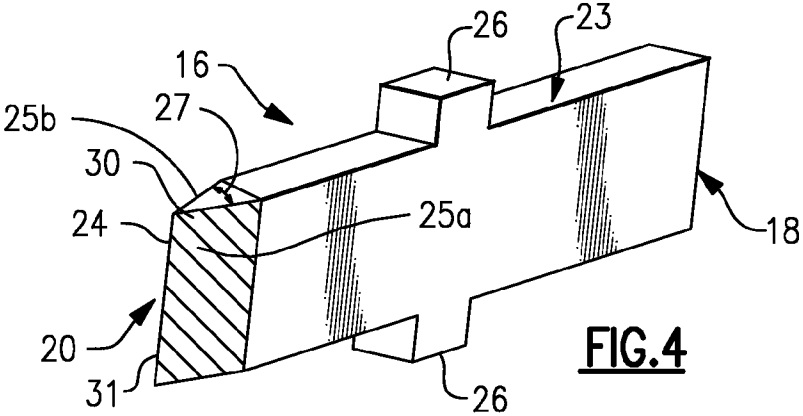
FIG. 4 illustrates a perspective view of an example spacer of the masking fixture.
Figure 3:
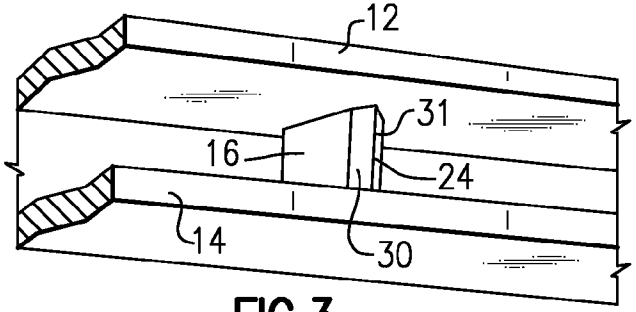
FIG. 3 illustrates a perspective view of a portion of the example masking fixture.

Referring also to FIGS. 3 and 4, each of the spacers 16 includes a radially outer end 18 and a radially inner end 20 relative to the center axis 22 of the masking fixture 10. In this example, the spacer 16 is a generally elongated rectangular body 23 that tapers to a knife edge 24 at the radially inner end 20 to facilitate reducing coating deflection and coating adherence, as will be described below.

In this example, angled sides 25*a* and 25*b* of the spacer 16 taper from the rectangular body 23 to form the knife edge 24. The amount of taper and sharpness of the knife edge 24 may be selected based upon a desired effect of the knife edge 24 on the coating process. For example, the sides 25*a* and 25*b* form an angle 27 that is selected during a design stage to achieve a desired effect in the coating process. The angle 27 may be substantially obtuse (e.g., greater than about 90°), in which case the coating material would impinge upon the sides 25*a* and 25*b* with a relatively high angle of incidence. Alternatively, the angle 27 may be substantially acute (e.g., less than about 90°), in which case the coating would impinge upon the sides 25*a* and 25*a* with a relatively lower angle of incidence. For example, the angle 27 may be 60°, 40°, or even lower, depending on a desired angle of incidence of the coating material.

Additionally, in the disclosed example, the knife edge 24 includes a radius of curvature at a tip 31 that may also be selected during a design stage to achieve a desired effect in the coating process. For example, the radius of curvature is about 0.025-0.050 inches (0.635-1.27 mm), and may be selected based on the selected angle 27. Given this description, one of ordinary skill in the art will recognize other suitable angles 27 and radii of curvature may achieve a desired effect in the coating process.

Tabs 26 extend outwards from the spacer 16 between the radially outer end 18 and the radially inner end 20. The first fixture plate 12 and the second fixture plate 14 include corresponding slots 28 that engage the tabs 26 to secure the spacers 16 between the plates 12 and 14. The edges of the tabs 26 may be melted in a welding process to bond the plates 12 and 14 with the spacers 16. Alternatively, the plates 12 and 14 could include the tabs 26 and the spacers 16 could include the slots 28. Using the tabs 26 and slots 28 to secure the plates 12 and 14 together facilitates reducing complex machining to produce the masking fixture 10, while achieving a desired degree of flatness of the masking fixture 10.

At least a portion of the radially inner end 20, knife edge 24 and sides 25*a*, 25*b* may be coated with a protective coating 30. For example, the protective coating 30 is harder than the underlying material of the spacer 16. In one example, the protective coating 30 is titanium nitride (TiN). The protective coating 30 facilitates reducing wear of the knife edge 24 and limiting adherence of the coating material to the spacer 16. For example, a relatively harder and smoother protective coating 30 provides a relatively greater degree of wear resistance. Given this description, one of ordinary skill in the art will recognize other types of protective coatings may achieve a desired effect in the coating process.

Figure 5:
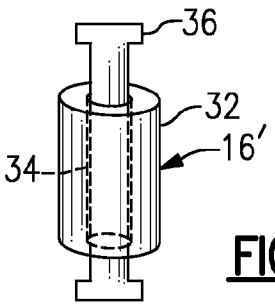
FIG. 5 illustrates a perspective view of another example spacer.

FIG. 5 illustrates another spacer 16' that may be secured between the first fixture plate 12 and the second fixture plate 14. In this example, the spacer 16' is a cylindrical sleeve 32 having a central bore 34. A fastener 36, such as a bolt, is received through the central bore 34 and slots 28 (FIG. 2) to secure the spacer 16' to the first fixture plate 12 and the second fixture plate 14. The curved sides of the cylindrical sleeve 32 provide a relatively low angle of incidence that facilitates reducing coating deflection and coating adherence, similar to as described above for the tapered sides 25*a* and 25*b*. Optionally, the spacer 16' may be coated with the protective coating 30 to facilitate reducing wear of the spacer 16' and adherence of coating material.

Figure 6:
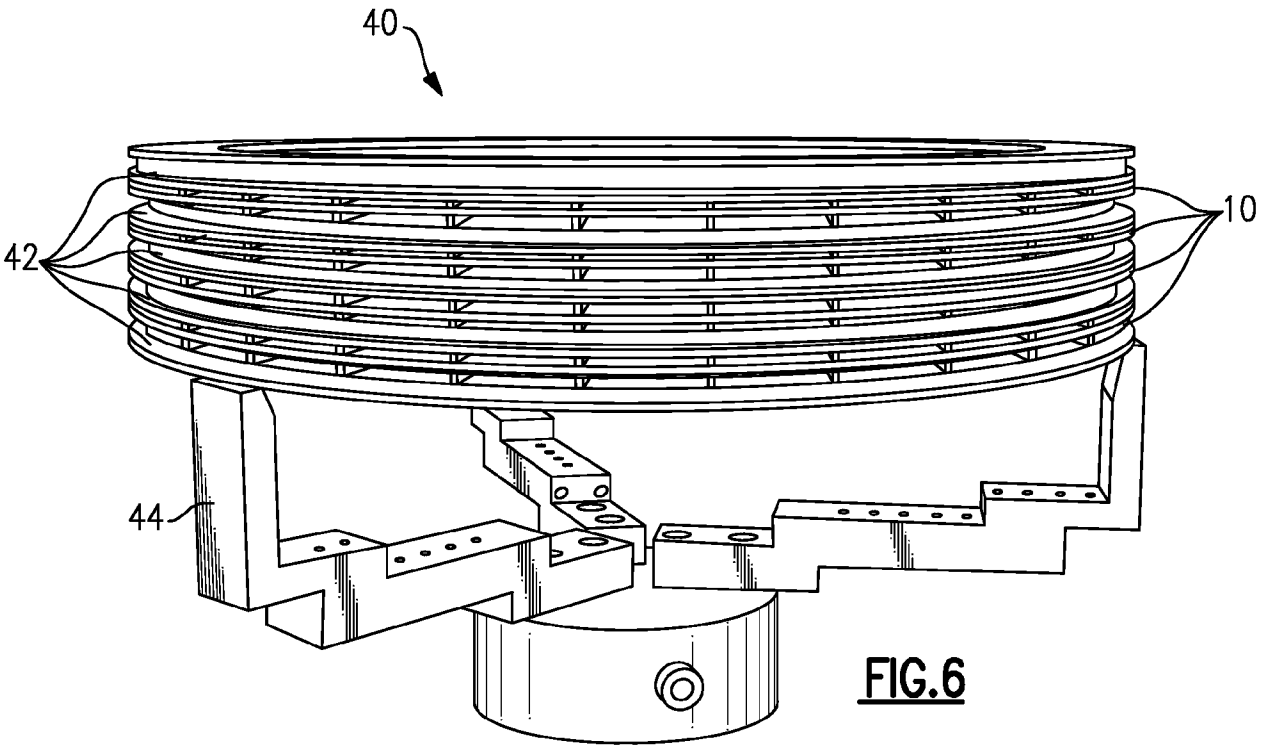
FIG. 6 illustrates a perspective view of a stacked arrangement of masking fixtures and work pieces.

FIG. 6 illustrates an example stacked arrangement 40 of a plurality of the masking fixtures 10 with a plurality of work pieces 42, such as compressor outer air seal rings. In this example, the stacked arrangement 40 is mounted on a tripod turntable support 44. However, in other examples, the stacked arrangement 40 may be mounted on another type of suitable support, depending on the type of coating process.

Figure 7:
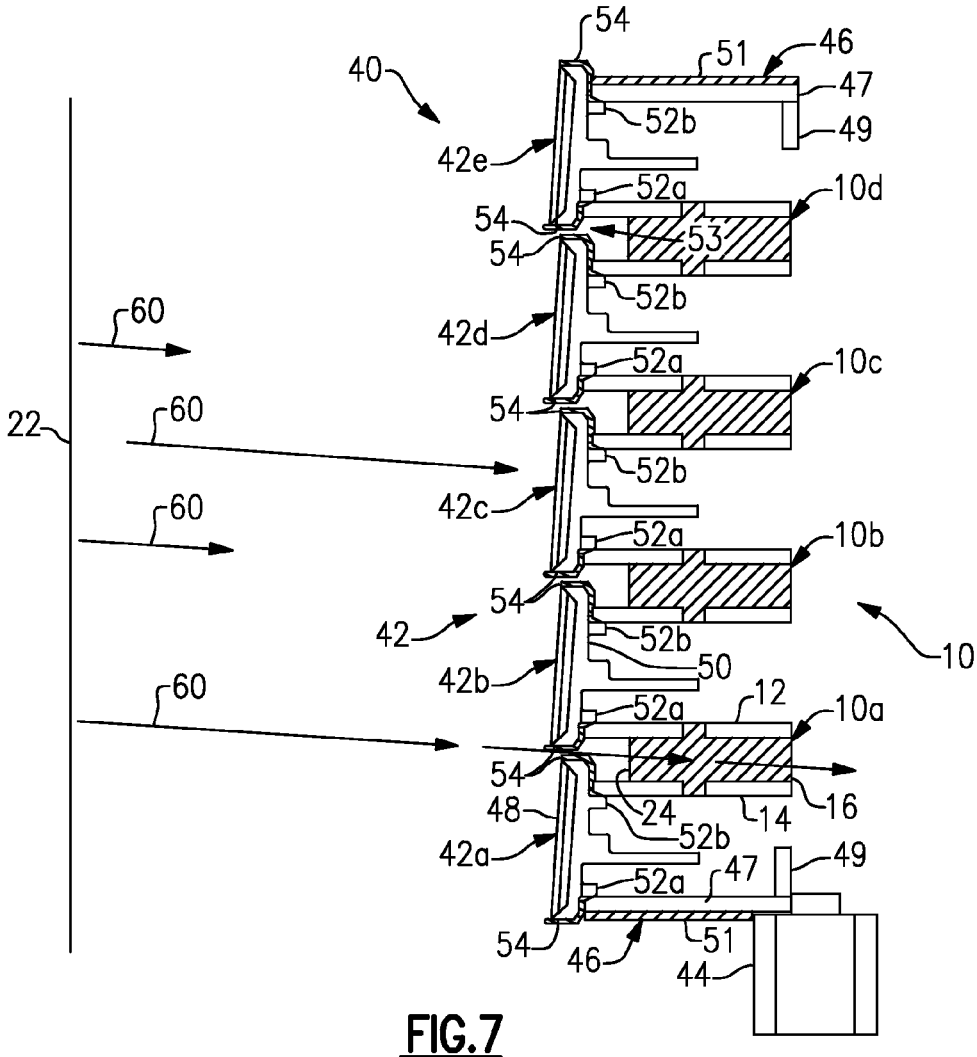
FIG. 7 illustrates a partial cross-sectional view of the stacked arrangement.

FIG. 7 is a sectional view of the stacked arrangement 40 axially stacked with respect to the center axis 22 on a leg of the tripod turntable support 44. The stacked arrangement 40 includes masking fixtures 10 indicated as 10*a*, 10*b*, 10*c*, and 10*d*, and work pieces 42 indicated as 42*a*, 42*b*, 42*c*, 42*d*, and 42*e* that are alternately stacked with the masking fixtures 10.

Cover fixture plates 46 are located on the top and bottom of the stacked arrangement 40. It is to be understood that fewer work pieces 42 or more work pieces 42 than is shown in the disclosed example may be stacked using the masking fixtures 10.

Each of the cover fixture plates 46 includes a substantially flat cover plate 47 and, optionally, a flange 49 that extends approximately perpendicularly from the cover plate 47. The flanges 49 facilitate stiffening of the cover plates 47 to reduce bowing that might otherwise impair sealing with work pieces 42*a* and 42*e*. A rubber layer 51 may be included on the flat cover plates 47 to deflect any coating material away from the stacked arrangement 40.

In the disclosed example, each of the work pieces 42*a*-42*e* includes a radially inner side 48 and a radially outer side 50, relative to the center axis 22. In this example, the inner side 48 generally faces radially inwards toward the center axis 22. For example, the inner side 48 is slightly angled relative to the center axis 22. The outer side 50 includes flanges 52*a* and 52*b*. In this example, the outer side 50 is not to be coated and is masked by the masking fixtures 10, thereby eliminating the need to use masking tape on the outer side 50.

In the disclosed example, the bottommost work piece 42*a* is supported on the bottom cover fixture plate 46 using the bottom flange 52*a*. The masking fixture 10*a* is stacked on the top flange 52*b* of the bottom work piece 42*a*. The bottom flange 52*a* of the second work piece 42*b* is supported on the first masking fixture 10*a*. The second masking fixture 10*b* is stacked on the top flange 52*b* of the second work piece 42*b*, and the bottom flange 52*a* of the third work piece 42*c* is supported on the second masking fixture 10*b*. The masking fixtures 10*c* and 10*d* and the work pieces 42*c*, 42*d*, and 42*e* are stacked in a similar manner up to the top cover fixture plate 46, which is supported on the top flange 52*b* of the top work piece 42*e*.

Adjacent masking fixtures 10 facilitate establishing a gap 53 between adjacent work pieces 42. For example, the masking fixtures 10 are designed to facilitate defining a gap size that reduces bridging of the coating across neighboring work pieces 42. In this example, the axial edges of each work piece 42 near the gaps 53 include a masking tape 54 to reduce coating deposition on the axial edges. It is to be understood that in other examples using other work pieces, the use of masking tape may be entirely eliminated or additional masking tape may be used.

In the disclosed example, the coating is applied onto the work pieces 42 in a line-of-sight spray process, such as thermal spraying. One example thermal spraying process is high velocity oxygen fuel ("HVOF") spraying, such as for depositing carbide coatings that are generally difficult to remove from conventional fixtures. In this regard, surfaces of the work pieces 42 and masking fixtures 10 that will be in the line-of-sight, and thereby exposed to the coating, can be estimated by coating lines-of-sight 60, which may extend approximately perpendicular to the inner sides 48.

The masking fixtures 10 facilitate supporting and masking the work pieces 42 with relatively little exposure of the masking fixtures 10 to the lines-of-sight 60. When disposed in stacked arrangement 40, the work pieces 42 interrupt the lines-of-sight 60 such that the first fixture plates 12 and the second fixture plates 14 of each of the masking fixtures is not directly exposed to the lines-of-sight 60. That is, each of the work pieces 42 is disposed between the center axis 22 and one of the first fixture plates 12 of one of the masking fixtures 10 and between the center axis 22 and the second fixture plates 14 of another of the fixtures 10. For example, the work piece 42*b* is disposed between the center axis 22 and the first fixture plate 12 of the masking fixture 10*a* and is disposed between the center axis 22 and the second fixture plate 14 of the masking fixture 10*b*.

In the disclosed example, the masking fixtures 10 mask the outer sides 50 of the work pieces 42. The first fixture plates 12 engage the bottom flanges 52*b* of the work pieces 42, and the second fixture plates 14 engage the top flanges 52*b* to facilitate reduction of coating deposition on the outer sides when any coating material may deflect or deviate from the lines-of-sight 60.

At least a portion of the coating material in the spray process travels through the gap 53 between the work pieces 42 as overspray. Compared to at least some known fixtures, spacers 16 reduce deflection of the overspray back toward the work pieces 42 and the center axis 22 and reduce coating build-up. For example, the knife edge 24 provides a low angle of incidence that limits deflection off of the spacers 16. The amount of taper and radius of curvature of the knife edge 24 may be selected to achieve a desired angle of incidence for reducing coating deflection and coating build-up. Although the coating may build-up on the knife edge 24 in some examples, the low angle of incidence facilitates reducing the thickness of the build-up.

The protective coating 30 on the knife edge 24 also facilitates reducing wear and adherence of the spacer 16. Additionally, the surfaces of the spacers 16 and the protective coating 30 may be polished to a smooth finish, such as by using electro-polishing, to limit mechanical interlocking of the coating material.

Figure 8:
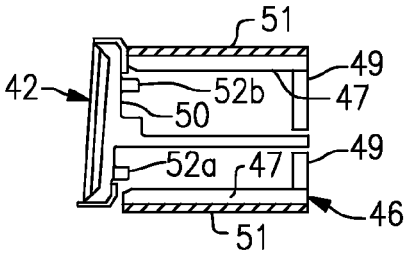
FIG. 8 illustrates a cross-sectional view of a single work piece mounted using cover plate fixtures.

As illustrated in FIG. 8, the cover fixture plates 46 may also be used for other processes, such as grit blasting. In the illustrated example, the cover fixture plates 46 are designed to protect a single one of the work pieces 42 during a grit blast process. The cover fixture plates 46 support the work piece 42 using the flanges 52*a* and 52*b*, as described above. The flanges 49 of the cover fixture plates 46 extend across the outer side 50 of the work piece 42 such that the cover fixture plates 46 block the outer side 50 from exposure to grit material. The rubber layers 51 deflect the grit material to protect the flat cover plates 47 from wear.

Figure 9:
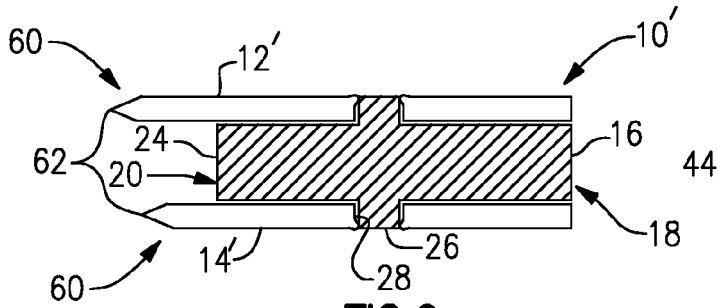
FIG. 9 illustrates a cross-sectional view of another example masking fixture.

FIG. 9 illustrates another example masking fixture 10' that is adapted for use as a top or bottom cover instead of using the cover fixture plates 46, or for supporting a single one of the work pieces 42. For example, a radially inner end 60 of the first fixture plate 12', the second fixture plate 14', or both includes a knife edge 62 and, optionally, a protective coating 30' that is similar to the protective coating 30 discussed above. As a top or bottom cover, the respective first fixture plate 12' or second fixture plate 14' is exposed to the line-of-sight 60. The knife edge 62 functions similar to the knife edge 24 to provide a low angle of incidence that facilitates reducing coating deflection and coating adherence.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A masking fixture for use in a coating process, comprising:

a first fixture plate operable to support a first work piece in a first work piece position;

a second fixture plate spaced from the first fixture plate and operable to support a second work piece in a second work piece position, and the first fixture plate and the second fixture plate are respectively behind the first work piece position and the second work piece position relative to a coating deposition line-of-sight, wherein each of the first fixture plate and the second fixture plate comprises an arced portion and the second fixture plate is supported on the first work piece; and at least one spacer secured between the first fixture plate and the second fixture plate, wherein the at least one spacer or the first fixture plate and the second fixture plate include tabs and the other of the at least one spacer or the first fixture plate and the second fixture plate includes slots for receiving the tabs to secure the at least one spacer, the first fixture plate, and the second fixture plate together.

2. The masking fixture as recited in claim 1, wherein each of the first fixture plate and the second fixture plate is substantially flat.

3. The masking fixture as recited in claim 1, wherein the first fixture plate is substantially parallel to the second fixture plate.

4. The masking fixture as recited in claim 1, wherein the at least one spacer comprises a knife edge.

5. The masking fixture as recited in claim 1, wherein at least one of the first fixture plate or the second fixture plate comprises a knife edge.

6. The masking fixture as recited in claim 5, wherein the knife edge includes a protective coating.

7. The masking fixture as recited in claim 1, wherein the at least one spacer includes a protective coating.

8. The masking fixture a recited in claim 7, wherein the protective coating comprises titanium nitride.

9. The masking fixture as recited in claim 1, wherein the at least one spacer includes the tabs and the first fixture plate and the second fixture plate include the slots.

10. The masking fixture as recited in claim 1, wherein each of the first fixture plate and the second fixture plate is a ring.

11. The masking fixture as recited in claim 10, wherein the at least one spacer comprises a plurality of spacers spaced around a circumference of the first plate fixture and the second plate fixture.

12. A masking fixture arrangement for use in a coating process, comprising:

a plurality of masking fixtures in an alternating stacked arrangement with a plurality of work pieces, each masking fixture having a first fixture plate for supporting one of the work pieces, a second fixture plate spaced from the first fixture plate for supporting another of the work pieces, and a spacer secured between the first fixture plate and the second fixture plate, each of the first fixture plates and the second fixture plates is a ring that is approximately concentric with a center axis, at least one of the plurality of work pieces is at least partially between the center axis and at least one of the plurality of masking fixtures and the first fixture plate and the second fixture plate are behind respective ones of the work pieces relative to a coating deposition line-of-sight.

13. The masking fixture arrangement as recited in claim 12, wherein at least one of the plurality of work pieces is supported between at least two of the plurality of masking fixtures.

14. The masking fixture arrangement as recited in claim 12, wherein at least one of the plurality of work pieces is at least partially between the center axis and two of the plurality of masking fixtures.

15. The masking fixture arrangement as recited in claim 12, wherein at least one of the work pieces is between the center axis and one of the first fixture plates of one of the masking fixtures and also between the center axis and one of the second fixture plates of another of the masking fixtures.

16. The masking fixture arrangement as recited in claim 12, further including at least one cover fixture plate having a substantially flat cover.

17. The masking fixture arrangement as recited in claim 16, wherein the at least one cover fixture plate includes a rubber layer.

18. The masking fixture as recited in claim 1, wherein the first fixture plate and the second fixture plate are arranged to mask the backsides of the first work piece and the second work piece relative to the coating deposition line-of-sight.

19. The masking fixture arrangement as recited in claim 12, wherein one of the plurality of masking fixtures is stacked on top of one of the plurality of work pieces followed by another of the plurality of masking fixtures.

20. The masking fixture arrangement as recited in claim 1, wherein a top cover fixture plate is located above the first fixture plate and second fixture plate, and a bottom cover fixture plate is located below the first fixture plate and second fixture plate, each of the top cover fixture plate and the bottom cover fixture plate includes a perpendicular flange.

21. The masking fixture arrangement as recited in claim 4, wherein the knife edge includes a radius of curvature at a tip of about 0.025-0.050 inches.

* * * * *